United States Patent [19]

Tilly

[11] Patent Number: 5,046,548

[45] Date of Patent: Sep. 10, 1991

[54] DEVICE FOR PREPARING PUTTY AND SIMILAR MASSES

[76] Inventor: Leif Tilly, Blankavägen 15, S-433 62 Partille, Sweden

[21] Appl. No.: 473,970

[22] PCT Filed: Oct. 20, 1988

[86] PCT No.: PCT/SE88/00549

§ 371 Date: Apr. 18, 1990

§ 102(e) Date: Apr. 18, 1990

[87] PCT Pub. No.: WO89/03723

PCT Pub. Date: May 5, 1989

[30] Foreign Application Priority Data

Oct. 20, 1987 [SE] Sweden ..... 8704073

[51] Int. Cl.[5] ..... F28D 7/10

[52] U.S. Cl. ..... 165/1; 165/140; 165/156; 366/147; 366/339

[58] Field of Search ..... 165/140, 155, 156, 163, 165/1; 366/24, 147-149, 339

[56] References Cited

U.S. PATENT DOCUMENTS

| | | | |
|---|---|---|---|
| 1,526,320 | 2/1925 | Cook | 165/140 X |
| 1,852,490 | 4/1932 | Sullivan | 165/156 |
| 1,871,322 | 9/1932 | Hodgins | 165/156 X |
| 2,425,669 | 8/1947 | Brock | 165/156 X |
| 2,639,898 | 5/1953 | Reich | 366/147 X |
| 2,954,965 | 10/1960 | Sebald | 165/140 |
| 3,020,026 | 2/1962 | Peeps et al. | 165/156 |
| 3,887,881 | 4/1975 | Ono et al. | 422/135 |
| 4,009,751 | 3/1977 | Zelnik | 165/1 |
| 4,090,558 | 5/1978 | Akama | 165/155 |
| 4,402,361 | 9/1983 | Dominguez | 165/156 |
| 4,471,836 | 9/1984 | Hokanson | 165/111 |

*Primary Examiner*—Allen J. Flanigan

*Attorney, Agent, or Firm*—Ostrolenk, Faber, Gerb & Soffen

[57] ABSTRACT

A device for tempering and homogenizing viscous masses, particularly putty, and incorporating a combined heat exchanger and homogenizer (10), having a tubular part (12) through which the putty under pressure and tempering is caused to pass. In said tubular part (12) is provided a guiding device (16) designed compulsory to give the putty a plurality of direction changes relative to the tubular part (12). The guiding device (16) incorporates at least a first helical heat exchanger tube (17) arranged around a centrally disposed, second heat exchanger tube (18).

9 Claims, 1 Drawing Sheet

DEVICE FOR PREPARING PUTTY AND SIMILAR MASSES

The present invention refers to a device for heating and homogenizing viscous masses, particularly putty, the device incorporating a combined heat exchanger and homogenizer, having a tubular part through which the putty under pressure and heating is caused to pass, and in which tubular part is provided a guiding device designed compulsory to form the putty into a plurality of direction changes relative to the tubular part.

BACKGROUND OF THE INVENTION

When producing objects consisting of bigger units, which shall be sealingly interconnected, sealing agents are widely used in the form of especially developed qualities of putty. For this purpose putties have been developed with a substantial ability to penetrate into even very small spaces and joints and thereby form a continuous sealing layer which is resistant to chemical as well as mechanical influence.

It thereby has been possible to attain considerable profits. At manufacture e.g. of car bodies it thus has been possible to abandon the method of tight welding entire joints and instead to use spot welding for interconnecting the car body parts, and then a special putty under high pressure is pressed into the joints.

The demands placed upon such a putty are of course very large. The viscosity at the moment of application as well as the homogenity of the material are thereby of crucial importance. For this reason, as an example, in the just mentioned application of the putty permitted temperature tolerance of the putty thus is ±0.5° C. only. It certainly has been possible, fairly to hold such a temperature, but the problem has been to obtain also a sufficient homogenity in combination with a rational manufacture.

In a known device the putty is pumped from a drum and is pressed through a heated pipe. This will cause the phenomenon that putty, due to the friction, as a thin surface layer will adhere to the inner envelope surface of the pipe and become immobile. This layer will solidify and build up radially inwards so that the flow area gradually will be reduced and finally becomes so small that the process must be interrupted and a time-wasting cleaning operation must be begun.

Another drawback is that the components of the putty on its path from the drum to the putty gun are separated, which refers particularly to bonding agents therein, which means that some putty portions will contain too much and other too little bonding agent.

In DE-A-2364500 is shown a combined heat exchanger and static mixer for photographic emulsions, which shall have a temperature between 35° and 40° C. The device consists of an outer tube and an inner pipe extending axially therethrough, which inner pipe has external helically extending segments. The heating medium flows through the inner pipe, whereas the emulsion passes between the inner pipe and the outer tube and the helically extending segments afford the emulsion a helical path. A temperature tolerance as low as 0.5° C., which is permitted for putty is considered to be difficult to maintain with this device.

PURPOSE AND MOST ESSENTIAL FEATURES OF THE INVENTION

The purpose of the invention therefore is to provide a simple and efficient plant which requires a minimum of maintenance, and which guarantees a homogenous mass of putty of correct temperature.

For performing this and other purposes the invention has ben given the features appearing in the claims.

DESCRIPTION OF THE DRAWINGS

In the accompanying drawings are shown some embodiments as examples of the invention.

DESCRIPTION OF THE EMBODIMENTS

Figure 1:
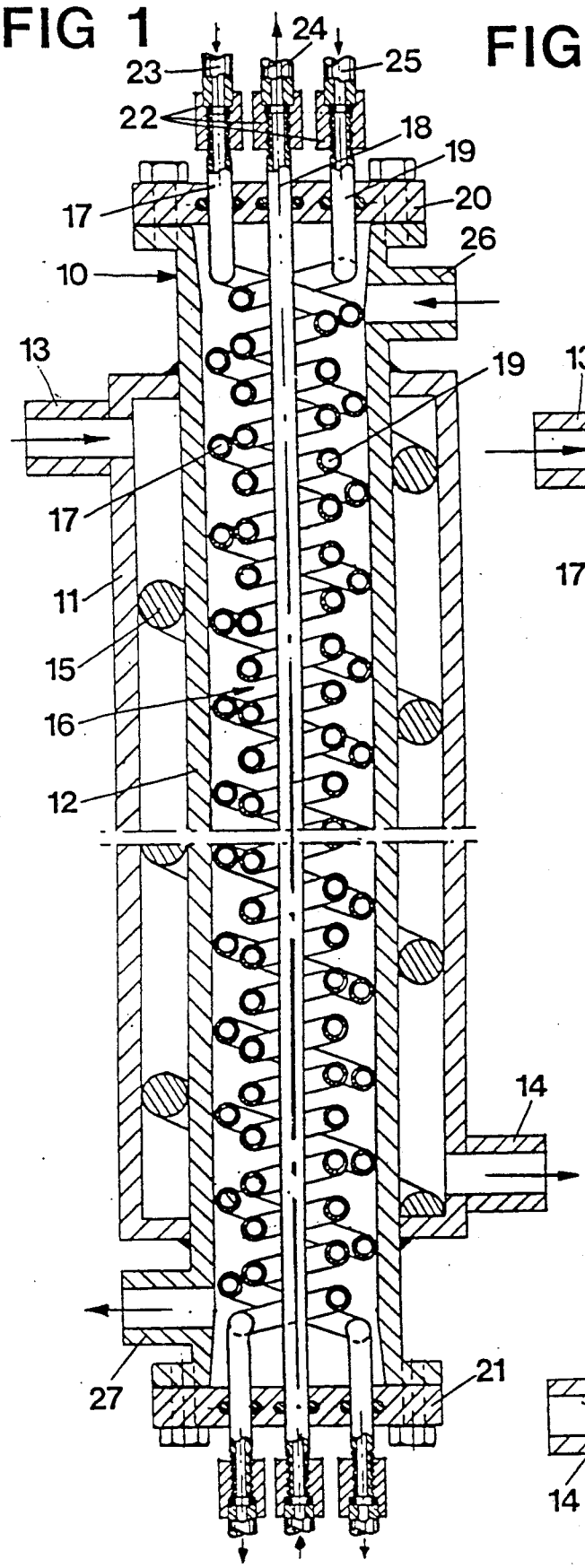
FIG. 1 is a longitudinal section through a device according to the invention.

The homogenizer 10 according to FIG. 1 consists of an outer tubular casing 11, which is closed at its ends, and through which extends an inner tubular part 12. The casing 11 at one end has an inlet 13 and at the opposite end an outlet 14 for the tempering fluid, e.g. water. Between the inner tubular part 12 and the outer casing 11 is provided a guiding member 15, which gives the water a helical movement in its path through the tempering or heating zone. In the tubular part 12 is inserted a guiding member 16 and consisting of a first helical heat exchanger tube 17 provided around a centrally disposed second heat exchanger tube 18 extending axially through the tubular part 12. A helical, third heat exchanger tube 19 is further provided around the central heat exchanger tube 18 and has opposed pitch as compared to the first heat exchanger tube 17. Tempered or heated water is supplied to all heat exchanger tubes, whereby according to FIG. 1 the central tube 18 is supplied with water in opposite direction to that of the two helical tubes 17 and 19.

The tubular part 12 at its ends is closed by end plates 20 and 21, which are detachably attached to the part 12, e.g. by means of screws. The ends of the heat exchanger tubes 17, 18, 19 are led through sealed off openings in the end plates and the end portions situated outside the end plates have external threads and are by means of nuts 22 detachably attached to the associated extension tubes 23, 24 and 25 resp. Cleaning of the device is facilitated thereby, as the heat exchanger tubes 17, 18, 19 may be disconnected and taken out from the tubular part 12.

The tubular part 12 has at one of its ends an inlet 26, through which putty under high pressure is introduced in the tubular part 12 in order to afterward to leave it through an outlet 27 at the opposite end, from which the putty passes to one or more not shown nozzles or the like for application of the putty.

The putty, which, via the tempering or heating fluid flowing on one hand through the tubes 17, 18, 19 and on the other hand inside the casing 11, is maintained at the prescribed temperature, is pressed through the homogenizer at a pressure, which at the application for manufacture of car bodies here described amounts to 350 bars.

The mass of putty is thereby urged to make a number of direction changes against the helical heat exchanger tubes 17, 19 in contact with the outside of the central heat exchanger tube 18 and against the inner side of the tubular part 12, which is likewise tempered by the tempering fluid. It thus is obvious that the mass receives an even heat supply at the same time as an efficient admixing is obtained and its tendency of adhering to the inner surface the tubular part 12 is reduced.

Figure 2:
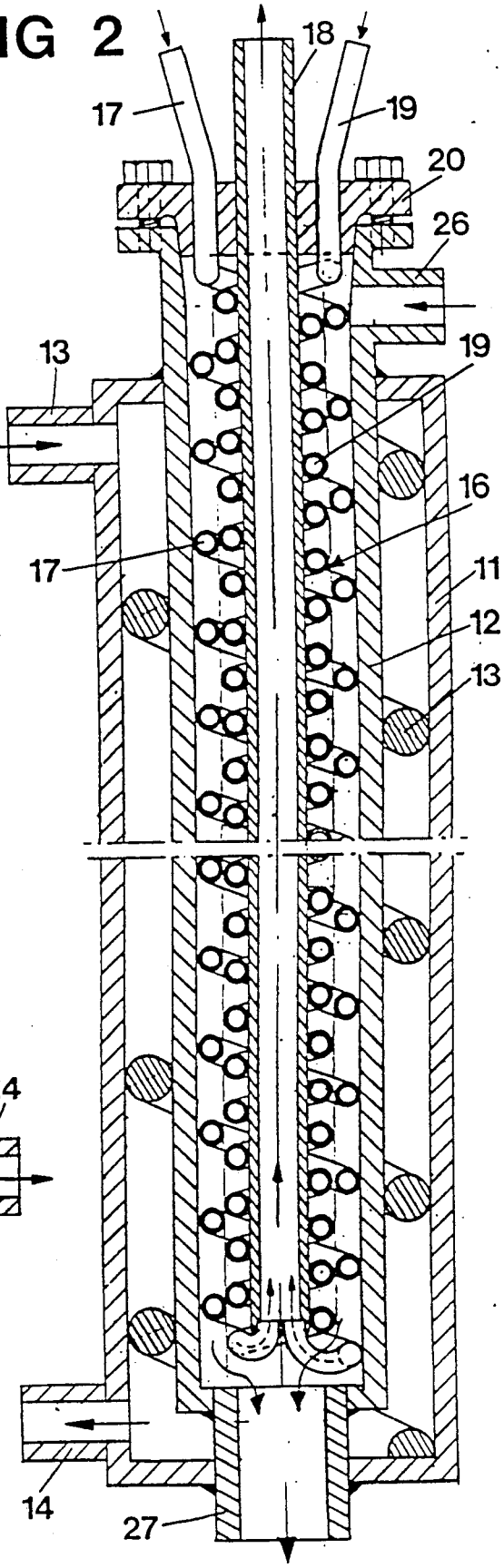
FIG. 2 is a corresponding longitudinal section through another embodiment of the invention.

The embodiment shown in FIG. 2 differs from the one shown in FIG. 1 in that the two helical heat exchanger tubes 17 and 19 at the outlet end of the device are bent in towards the central heat exchanger tube 18 and open into the tube 18. The tempering or heating fluid hereby after having passed through the helical heat exchanger tubes 17, 19 is caused to enter the central heat exchanger tube 18 and to leave it at the opposite end thereof. The tubular part 12 has only at one of its ends, the inlet end, a detachably attached end plate 20, whereby it is possible, by unbolting said end plate 20, to remove the heat exchanger tubes 17, 18 and 19 for cleaning the device.

The invention is of course not limited to embodiments shown but a plurality of modifications is possible within the scope of the claims.

I claim:

1. A device for heating and homogenizing a viscous mass, comprising:

a tube defining a flow passage for the viscous mass, the tube having an inlet for viscous material at one end of the flow passage and having an outlet spaced away from the inlet along the tube at the other end of the flow passage for outlet of the viscous material;

a first helically coiled tube heat exchanger disposed inside the tube between the inlet and the outlet for guiding the viscous mass through the flow passage inside the tube and for mixing and homogenizing and for heating the viscous mass;

a second tube heat exchanger disposed generally centrally in the tube between the inlet and the outlet, the first helically coiled tube heat exchanger being coiled around the second heat exchanger, the second heat exchanger also being for heating the viscous mass moving through the flow passage;

a third helically coiled tube heat exchanger disposed inside the tube between the inlet and the outlet, the third heat exchanger also being helically coiled around the central second heat exchanger, and the helical coil of the third heat exchanger having the opposite pitch from the helical coil of the first heat exchanger.

2. The device of claim 1, further comprising respective first, second and third means for communicating fluid heating medium to the first, second and third heat exchangers, the means for communicating fluid to the first and third heat exchangers directing the fluid in one direction through the respective heat exchanger and through the tube and the means for communicating fluid to the second heat exchanger directing the fluid in a second opposite direction through the second heat exchanger and through the tube.

3. The device of claim 1, further comprising a hollow casing around the tube and extending over the flow passage for the viscous mass, the casing having a casing inlet for heating fluid and a casing outlet for the heating fluid spaced along the casing from the casing inlet.

4. The device of claim 3, further comprising a guide disposed in the casing for guiding the heating fluid in the casing along a generally helical path.

5. The device of claim 4, wherein the guide in the casing comprises a detachable insert therein.

6. The device of claim 3, wherein the tube has an end, a detachable end plate is attached over the tube end and the tube heat exchangers extend through and are supported to the end plate.

7. The device of claim 2, wherein the first and third tube heat exchangers have a fluid inlet for fluid and a fluid outlet, and the second tube heat exchanger has a fluid inlet and a fluid outlet, the outlet from the first and third heat exchangers empties into the inlet for the second heat exchanger, whereby the heat exchanger fluid from the helical tube heat exchangers flows back through the central tube hat exchanger.

8. The device of claim 1, wherein the first and third tube heat exchangers have a fluid inlet for fluid and a fluid outlet, and the second tube heat exchanger has a fluid inlet and a fluid outlet, the outlet from the first and third heat exchangers empties into the inlet for the second heat exchanger, whereby the heat exchanger fluid from the helical tube heat exchangers flow back through the central tube heat exchanger.

9. A method for heating and homogenizing a viscous mass, comprising:

feeding the viscous mass under pressure through a tube from an inlet in the tube to an outlet from the tube through a flow passage defined between the inlet and the outlet;

heating the viscous mass while feeding the viscous mass through the tube from the inlet and outlet;

the heating step comprising heating the viscous mass by first heating means extending straight through the center of the tube and by second heating means helically coiling around inside the tube, and directing the viscous mass through the flow passage along a pathway having many directional changes caused by the feeding of the viscous mass over the helical tube heat exchanger, for both homogenizing the viscous mass and for heating the entire viscous mass as it passes through the flow passage and comprising further heating the viscous mass by applying heat to the exterior of the tube in a heated casing around the tube.

* * * * *